United States Patent [19]

Webster

[11] Patent Number: 4,768,235

[45] Date of Patent: Sep. 6, 1988

[54] COLD WEATHER MASK AND HOOD

[76] Inventor: Margaret A. Webster, R.R. #1, Box 62, Tamarack, Minn. 55787

[21] Appl. No.: 40,883

[22] Filed: Apr. 21, 1987

[51] Int. Cl.[4] ..... A42B 1/04

[52] U.S. Cl. ..... 2/205; 2/84; 2/202; 128/201.26; 128/201.29; 128/204.17

[58] Field of Search ..... 2/205, 202, 206, 424, 2/84, 7, 5, 6, 9; 128/201.23, 201.22, 201.24, 201.26, 201.29, 207.13, 204.17

[56] References Cited

U.S. PATENT DOCUMENTS

| | | | |
|---|---|---|---|
| 296,499 | 4/1884 | Wisniewski | 2/202 |
| 1,395,948 | 11/1921 | Drager | 128/206.29 |
| 2,027,392 | 1/1936 | Manson | 128/201.15 |
| 2,631,287 | 3/1953 | Malcolm, Jr. | 2/9 |
| 2,642,574 | 6/1953 | Eloranta | 2/205 |
| 2,860,632 | 11/1958 | Conti | 128/200.27 |
| 2,896,617 | 7/1959 | Gibbons | 128/201.23 |
| 3,080,586 | 3/1963 | Steinke | 128/201.23 |
| 3,559,642 | 2/1971 | Cupp | 2/2 X |
| 3,680,555 | 8/1972 | Warncke | 128/206.24 |
| 3,768,100 | 10/1973 | Colman et al. | 2/206 X |
| 4,062,359 | 12/1977 | Geaghan | 128/204.17 |
| 4,148,958 | 4/1979 | Tischer et al. | 2/9 X |
| 4,215,437 | 8/1980 | Kao | 2/424 |
| 4,250,877 | 2/1981 | Owens et al. | 128/207.11 |
| 4,395,781 | 8/1983 | Myers | 2/84 |
| 4,411,023 | 10/1983 | Pinson | 2/205 X |
| 4,441,494 | 4/1984 | Montalbano | 128/204.17 |
| 4,610,247 | 9/1986 | Stroup | 128/207.13 X |
| 4,671,775 | 6/1987 | Hill | 2/202 X |

*Primary Examiner*—Peter Nerbun

*Attorney, Agent, or Firm*—Merchant, Gould, Smith, Edell, Welter & Schmidt

[57] ABSTRACT

A cold weather mask and hood (10) made of a flexible insulating layered material (39) which covers the wearer's entire head, shoulders and upper chest. A partially detachable face portion (11) contains a lens receptacle (13) which holds removable lens (15). An air intake hose (23) provides warm, fresh air for inhalation, and an exhaust tube (27) is used for exhalation. The exhaust tube (27) contains ridges (29) which hold the mask away from the lower face to form an air pocket (26).

24 Claims, 1 Drawing Sheet

FIG. 1
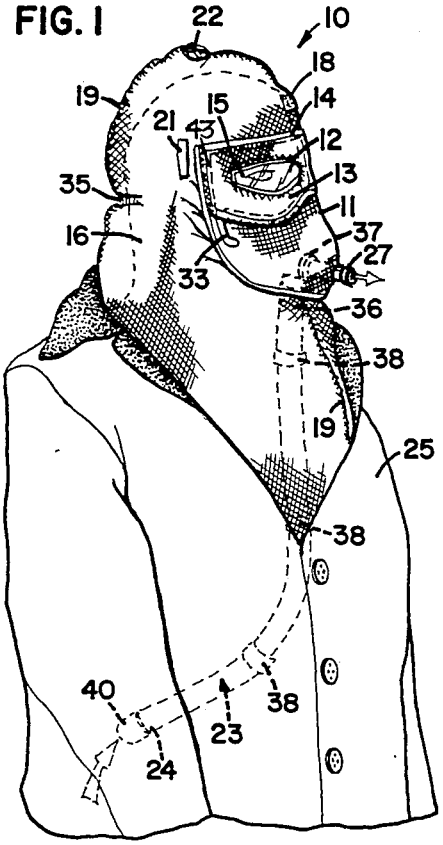
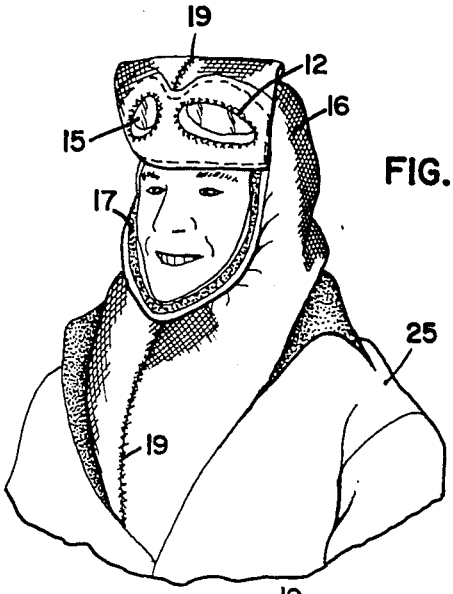
FIG. 2
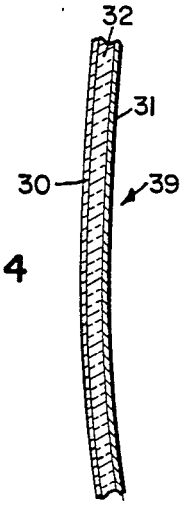
FIG. 4
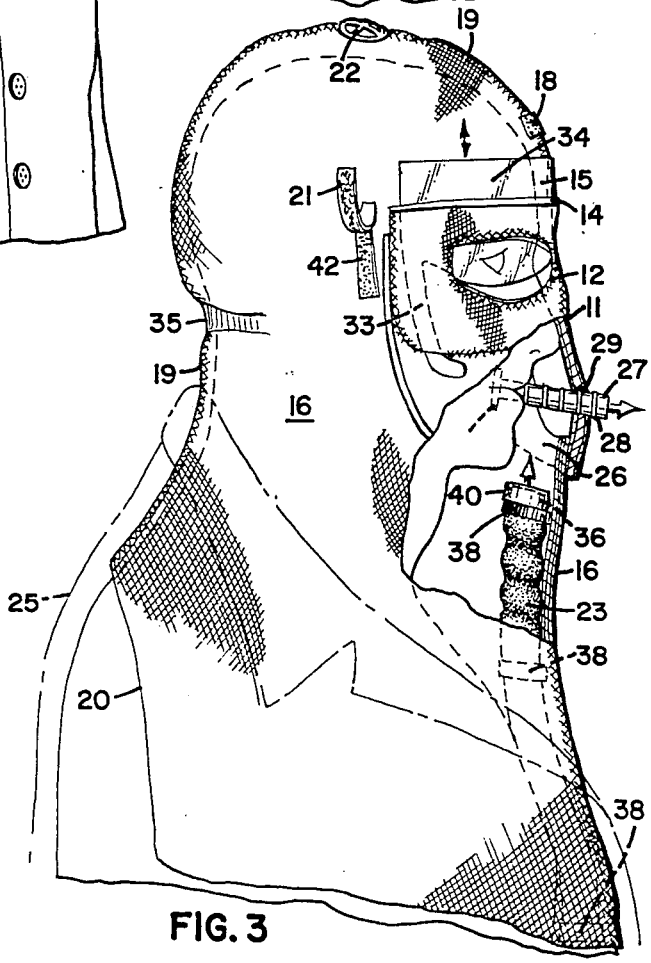
FIG. 3

COLD WEATHER MASK AND HOOD

FIELD OF THE INVENTION

The present invention relates to a cold weather face mask and hood for protection against the extremes of low temperature and high wind velocity.

BACKGROUND OF THE INVENTION

When walking, jogging, running, snowmobiling, skiing, mountain climbing, hunting or carrying out other physical activities in cold weather, one generally experiences a great deal of discomfort when exposed to extremely cold temperatures. Further, the inspiration of very cold dry air has the combined effect of loss of body heat and difficulty in breathing. Medical problems may be caused due to breathing in cold air when performing physical activities.

Face masks and hoods have been developed for the protection of the face and head under cold environmental conditions. However, these face masks and hoods often have open areas around the neck, eyes, nose, ears, and forehead. Consequently, these face masks and hoods are often not sufficiently warm, whereas in other circumstances, they may be too warm. It is particularly common for the eye area to be uncovered with these devices. This enables cold air to reach the areas of the face around the eyes, and it provides no protection to the eyes under conditions such as sleet and snow. If the eye area is covered, there is typically no means to prevent fogging or to allow for adjustment of the lens. Also, the configuration of the eye openings may result in poor visibility.

Another problem with conventional cold weather face masks is that they force the wearer to breathe cold air directly from the atmosphere. As a result, water and mucus can collect and cause discomfort and damage of frozen fabric. Further, the material from which conventional face masks are made often retains moisture, which results in a loss of insulating properties. These materials, especially knits, also may not have good wind breaking qualities.

Some cold weather face masks contain a breathing device which permits the wearer to breath warm air. However, this warm air is typically "used" air, rather than fresh air. In addition, the face masks and hoods developed previously are often heavy or bulky, and they are difficult to clean.

The present invention addresses these and many other problems associated with currently available cold weather masks and hoods.

SUMMARY OF THE INVENTION

The present invention comprises a cold weather mask and hood made of flexible insulating material which covers and encloses the wearer's head. The preferred material has three bonded layers, the combination of which exhibits several advantageous properties. The invention includes air intake means, which is preferably a flexible hose having an inlet end for fresh air and an outlet end which extends to a warm air pocket in front of the wearer's face. The air exhaust means is preferably a plastic tube having ridges which act to hold the face portion of the mask away from the wearer's lower face so that a warm air pocket of fresh air can be maintained. An elastic strip at the back of the hood serves to hold the upper portion of the mask relatively snugly against the wearer's face above the hose. According to one aspect of the present invention, there is provided lens which cover the mask's vision openings, the lens being held in a receptacle which allows the lens to be either completely removed or raised above the vision openings. According to another aspect of the invention, the face portion of the mask and hood is detachable and can be raised away from the face to provide cooling air flow and enhanced visibility.

The present invention is particularly advantageous in that is completely covers the face, eyes, neck, shoulders, head, and upper chest. The material insulates the body to keep warm air from escaping, yet it is made of a wind resistant and breathable fabric. Also, if the wearer becomes too warm, the present invention allows for increased air flow to reach the wearer's face. This is accomplished by either removing the lens away from the eye area, or by detaching the entire face portion of the hood and folding it back on top of the head. The Velcro attachment of the various components allow these temperature adjustments to be made quickly and conveniently.

Another feature of the present invention is a wide range of vision. The cutouts for the eyes are generous, and the mask fits close to the face in the eye area, so that visibility is maximized.

Yet another advantage of the present invention is the air intake system which allows the wearer to breathe fresh, yet warm, air. The fresh air is inhaled through a flexible hose which passes between the wearer's body and outerwear. The air passes through the hose and enters a warm air pocket proximate the wearer's face. This air pocket is maintained by an exhaust tube, one end of which contains a mouth piece which is held in the wearer's mouth, the other end of which contains ridges to hold the hood material away from the wearer's face to maintain the warm air pocket.

The present invention also features a unique combination of fabrics. The material is lightweight, comfortable, breathable, water resistant, wind resistant, comfortable when placed in contact with the wearer's face, easy to clean, and is able to "wick" moisture from the wearer's face to prevent freezing of the hood.

For a better understanding of the invention, and of the advantages obtained by its use, reference should be had to the drawings and accompanying descriptive matter, in which there is illustrated and described a preferred embodiment of the invention.

BRIEF DESCRIPTION OF THE DRAWINGS

Referring particularly to the drawings, wherein like references numerals indicate like parts throughout the several views:

FIG. 1 is a perspective view of the cold weather mask and hood of the present invention in use;

FIG. 2 is a perspective view of the apparatus shown in FIG. 1 with the face portion of the mask and hood folded back;

FIG. 3 is a side elevational view of the apparatus shown in FIGS. 1 and 2, partially in section; and FIG. 4 is a cross-sectional view of the material used with the cold weather mask and hood of the present invention.

DESCRIPTION OF THE PREFERRED EMBODIMENT

The cold weather mask and hood apparatus of the present invention is shown generally at 10. As shown, the mask and hood 10 covers the wearer's entire head, and it also covers the shoulders and upper chest area, to provide complete warmth and protection. The bottom of the mask and hood 10 tucks within the wearer's coat or outerwear 25 The hood can be made in different sizes to accommodate different-sized people in order assure a close, warm fit. The design of the hood and mask 10 is such that the front of the mask 10 is curved, rather than flat, to allow the wind to easily pass around it. This contour is especially important on days with high winds, or when traveling at high speeds in an outdoor vehicle. The hood 16 includes a vertical seam line 19 at its front. There is also a vertical seam line 19 at the back of the hood 16 which extends around the top and front portions of the hood 16. The back end of the hood 16 includes a V-shaped opening 20 which allows the wearer to easily slip on or remove the mask and hood 10.

The cold weather mask and hood 10 includes a face portion 11 and hood portion 16. The face portion 11 protects the wearer's face from cold temperatures and the elements. The face portion 11 has a pair of vision cutouts 12 for lens 15 which protect the wearer's eyes. The mask and hood 10 is made of a flexible, insulatable material 39 which keeps the wearer warm and dry. Preferably, buttonhole stitching is provided around the vision cutouts 12 to prevent tearing or ravelling of the material. The eye openings 12 are cut to be relatively wide, which allows the wearer to have a wide range of vision.

The face portion 11 also includes a lens receptacle 13. The lens receptacle 13 preferably comprises a transverse pocket around the area of the vision cutouts 12. The lens receptacle or pocket 13 extends across the entire width of the face portion 11, extending beyond the outer edges of the vision cutouts 12. In the preferred embodiment, the outer edges of the lens receptable 13 are secured with buttonhole stitching. The receptacle or pocket 13 also extends below the vision cutouts 12. The upper end 14 of the receptacle 13 is open to enable the lens 15 to be easily inserted or removed through the upper opening 14 of the receptacle. The pocket or receptacle 13 and lens 15 also provide another layer of insulating material around the sinus area, thereby giving double protection to this area. Preferably, the receptacle 13 is made of the same material as the remainder of the hood and mask 10.

In addition, the wearer can merely raise the lens 15 without totally removing the lens 15 from the receptacle 13. In this manner, the lens 15 are raised far enough so that the vision cutouts 12 are open. The top portion 14 of the lens receptacle 13 holds the lens 15 in place by friction when it is in its raised position. This movement is illustrated by the arrow in FIG. 3. Raising the lens 15 may be desirable to enhance visibility if the lens fog, or to allow the wearer to be cooled by increasing air flow to the face. Preferably, the lens 15 are made of a lightweight, fog resistant plastic. In the preferred embodiment, the lens 15 include a pair of eye portions and an integral interconnecting bridge portion. Also, the lens 15 may be tinted.

The lens 15 are preferably provided with a pair of integral longitudinal tabs 33 which are located at the outer edges of the lens 15. The tabs 33 extend below the main portion of the lens 15, and the tabs 33 can be contained within narrow vertical guide sleeves 43 in the lens receptacle 13. The tabs 33 facilitate the movement of the lens 15 up and down, and also allow the lens 15 to be securedly connected to the face portion 12 of the mask. The upper portion 34 of the lens 15 may extend somewhat above the vision cutouts 12 so that it is easy for the wearer to grasph the top 34 of the lens 15 for vertical adjustment.

Another novel feature of the present invention is that the face portion 11 is partially detachable from the hood 16. The face portion 11 can be detached from the hood 16 at its lower end and sides, and then secured to the top of the hood 16, as illustrated in FIG. 2. The bottom and side portions of the edge of the hood 16 proximate the face are provided with suitable fasteners such as a fastening strip 17 of hook and loop material. The inside edge of the face portion 11 is provided with a material which adheres suitably to the fastening strip 17. Also, the top of the hood 16 is provided with another suitable fastener, such as fastening strip 18 of hook and loop material, which secures and maintains the face portion 12 in its detached, raised position. Thus, when the wearer becomes too warm, or when he desires enhanced visibility, or when the weather conditions change, the wearer can simply detach the lower and side ends of the face portion 12 from the fastening strip 17 and secure the face portion 12 on the top of the hood 16 by means of the fastening strip 18.

Preferably, the hood 16 is provided with an elastic strip 35 on its back end. This elastic strip 35 allows for a close, comfortable fit of the hood 16 to the wearer's head and greater mobility. By improving the hood's fit, the elastic strip 35 also helps to keep the wearer warm. Further, it keeps the surface of the hood 16 close to the wearer's face so that the vision cutouts 12 are close to the wearer's face and the wearer has sufficient visibility.

With the hood and mask 10 of the present invention, the wearer's eyeglasses can either be worn inside or outside of the face portion 12. If they are worn on the outside, the bows (not shown) of the eyeglasses can be inserted within tabs 21 located on each side of the vision cutouts 12. Preferably, the tabs 21 have a suitable fastener thereon, such as fastening 42, to secure the bows of the eyeglasses in place.

Another feature of the hood 16 is the provision of a vent 22 proximate the top of the hood 16. The vent 22 can be open or closed as desired, and allows for the release of excess heat. It is preferably round in shape, with triangular openings which can be slidably opened or closed. It is preferably made of plastic.

The wearer receives fresh air from the atmosphere through an air intake hose 23. The air intake hose 23 is made of a flexible, reinforced material. Each end of the intake hose 23 may include a plastic cuff 40. Preferably, the intake hose 26 is approximately three (3) feet long, is corrugated for better flexibility, and is wire reinforced. The air goes into the inlet end 24 and out the outlet end 36 of the air intake hose 23 as illustrated by the arrows in FIGS. 1 and 3, respectively. The inlet 24 of the air intake hose 23 is exposed to the atmosphere by means of a slit (not shown) in the wearer's outerwear 25, through a pocket, or through the bottom of a jacket. The air intake hose 23 extends under the outerwear 25 next to the wearer's body. As the fresh air moves through the air intake hose 23, it is warmed by the wearer's body heat. The air escapes through an outlet end 36 of the air intake hose 23 into a warm air pocket 26 proximate the wearer's nose and mouth. The warm air pocket or fresh air chamber 26 preferably contains approximately 165 cubic inches of fresh, warm air. Thus, the wearer is able to breathe fresh, warm air, even on the coldest days.

The air intake hose 23 is secured to the inside of the hood 16, preferably by means of a plurality of elastic loops 38 at the front of the hood 16.

The wearer exhales air through an exhaust tube 27. The exhaust tube 27 is preferably made of a soft, flexible plastic and is a single integral piece. In the preferred embodiment, the exhaust tube is approximately five (5) inches long. The exhaust tube 27 includes an integral mouth piece 37 for insertion in the wearer's mouth. The exhaust tube 27 also includes a plurality of annular ridges 28. The ridges 28 have an outside diameter slightly larger than the diameter of an aperture 29 in the face portion 11 of the mask 10, so that the edges of the apertures 29 fit in a groove or edge fitting between consecutive ridges 28 to hold the face portion 11 at the desired distance away from the wearer's face. Also, the ridges 28 lend additional structural strength to the exhaust tube 27.

By holding the face portion 11 away from the face, a sufficiently large warm air pocket 26 is maintained for inhalation of air. As shown, the air pocket 26 is generally beneath the wearer's nose and in front of his mouth and neck. The mask is held away from the face by the exhaust tube 27 in the area below the nose to accommodate the air pocket 26, whereas the mask fits relatively snugly above the person's nose because of the elastic strip 35. The relatively snug fit above the nose allows the vision cutouts to be close to the wearer's face to enhance peripheral vision. Thus, the wearer inhales through his nose and exhales through his mouth.

Preferably, the hood and mask 10 of the present invention is made of a unique combination of material 39, as illustrated in FIG. 4. The outer fabric 30 is preferably made of a water resistant, lightweight, and durable fabric. An inner layer 31 is preferably made of a soft, lightweight fabric which is comfortable against the wearer's face. The middle layer 32 is preferably made of insulating material of sufficient thickness to provide warmth and insulation Preferably, the inner layer 31 is bonded to the middle insulating material layer. In this manner, a warm, lightweight, breathable, washable, and attractive material is provided. In addition, the mask and hood 10 can be made in a wide variety of colors. Also, reflective tape (not shown) can be provided about the face portion 12 for safety purposes.

In use, the wearer attaches the air intake hose 23 to the underside of the mask and hood 10 and slips the mask and hood 10 over his/her head. The wearer then puts on his coat so that the lower part of the hood 16 is tucked within the coat 25. The inlet end 24 of the air intake hose 23 is positioned to open into fresh air by extending the inlet end 24 through a slit in the coat or below the bottom of the coat. The wearer places the exhaust tube 27 through the face portion 11 of the mask and into his mouth. In this manner, the wearer inhales through his nose from air coming through the intake hose 23, and exhales from his mouth through the exhause tube 27.

If the wearer becomes too warm or desires enhanced visibility, he may raise the lens 15 above the lens receptacle to permit air to flow toward his face by gripping the top 34 of the lens. The wearer can also detach the entire face portion 11 of the mask by fastening it upon the top of his head as shown in FIG. 2.

Even though these numerous characteristics and advantages of the invention have been set forth in the foregoing description, together with details of the structure and function of the invention, the disclosure is illustrative only, and changes can be made in detail, especially in matters of shape, size and arrangement of parts, within the principles of the invention, to the full extent indicated by the broad general meaning of the appended claims.

What is claimed is:

1. A device for protecting a person's head in cold weather, comprising:

(a) a hood of flexible material, said hood completely enclosing said person's head, said hood including a face portion with means for seeing therethrough, said hood also including means for holding said hood material above said person's nose snugly to said person's face, said holding means including means for elastically gathering said hood material in a region behind a vertical plane through the forwardmost point of said person's ears and beneath the largest horizontal plane through said person's head when said person is standing erect, said hood further including means for forming a pocket in line with said person's nose generally beneath said person's nose and in front of said person's mouth and neck;

(b) means for inletting air from outside said hood to said pocket;

(c) means for exhausting air from said person's mouth to outside said hood enclosure; and (d) means for adjusting said hood so as to provide cooling air to the head when desired.

2. The device in accordance with claim 1 wherein said exhausting means includes a tube and a mouthpiece attached thereto, said face portion of said hood including an opening whereby said tube extends through said opening to direct air from said person through said mouthpiece and said tube to outside said hood enclosure.

3. The device in accordance with claim 3 wherein said pocket forming means includes a plurality of annular ridges on said tube, said opening in said hood having an edge fitting between a pair of annular ridges to hold said hood at a spaced distance from the face near said opening.

4. A device for protecting a person's head in cold weather, comprising:

(a) a hood of flexible insulating material completely enclosing the person's head, said hood having a face portion with a pair of vision cutouts for the person's eyes and a lens receptacle around said vision cutouts, said face portion having an air pocket thereunder proximate the person's nose and mouth;

(b) lens which fit within said lens receptable to protect the person's eyes;

(c) air intake means which warms fresh air from the atmosphere and transports the air to said pocket under said face portion of said hood wherein said air intake means includes a flexible intake hose proximate the inside of said hood, including an outlet end proximate the person's face and an inlet end open to fresh air in the atmosphere, said intake hosing extending under the person's outerwear, whereby air is warmed within the tube as it passes between the person's body and outerwear;

(d) means for exhausing air through said face portion of said hood; and (e) means for adjusting said hood so as to provide cooling air to the head when desired.

5. The device in accordance with claim 4 wherein said exhausting means includes a tube and a mouthpiece attached thereto, said face portion of said hood including an opening whereby said tube extends through said opening to direct air from said person through said mouthpiece and said tube to outside said hood enclosure.

6. The device in accordance with claim 7, wherein said tube includes a plurality of annular ridges, said opening in said hood having on edge fitting between a pair of annular ridges to hold said hood away from the person's face near said opening, wherein said air pocket is formed.

7. The device in accordance with claim 6 wherein said holding means includes means for elastically gathering said hood material in a region behind a vertical plane through the forwardmost point of said person's ears and beneath the largest horizontal plane through said person's head when said person is standing erect.

8. The device in accordance with claim 4, wherein said face portion includes a bottom and opposite sides, said face portion further including means for detachably attaching said bottom and said sides to said hood to enable the person to detach and fold said face portion away from the face.

9. The device in accordance with claim 7, wherein said hood comprises a plurality of layers, including means for repelling water and means for insulating the wearer.

10. The device in accordance with claim 7, further comprising a tab on each side of said hood for positioning eyeglasses outside of said hood by insertion of a bow of said eyeglasses into each tab.

11. The device in accordance with claim 7, wherein said hood includes a top portion, said hood further including a vent proximate said top portion.

12. A device for protecting a wearer's head in cold weather, comprising:

(a) a hood of flexible insulating material completely enclosing the wearer's head, said hood having a face portion with a pair of vision cutouts for the wearer's eyes and a lens receptacle around said vision cutouts, said face portion having an air pocket thereunder proximate the wearer's nose and mouth;

(b) lens which fit within said lens receptacle to protect the wearer's eyes; wherein said lens include a pair of eye portions and an integral interconnecting bridge portion, said lens further including a pair of longitudinal tabs extending downward from said lens, said lens being made of a plastic material;

(c) air intake means which warms fresh air from the atmosphere and transports the air to said pocket under said face portion of said hood; and (d) means for exhausting air through said face portion of said hood.

13. A device for protecting a person's head in cold weather comprising:

(a) a hood of flexible insulating material, said hood completely enclosing said person's head, shoulders and upper chest, said hood including a face portion with means for seeing therethrough, said face portion having an air pocket thereunder proximate the person's nose and mouth;

(b) a flexible air intake hose interconnected to the inside of said hood, including an outlet end proximate the person's face and an inlet end open to fresh air in the atmosphere, said intake hosing extending under the person's outerwear, whereby air is warmed as it passes between the person's body and outerwear; and (c) means for exhausting air through said face portion of said hood, including a tube and a mouthpiece attached thereto, said face portion of said hood including an opening whereby said tube extends through said opening to direct air from said person through said mouthpiece and said tube to outside said hood enclosure.

14. The device in accordance with claim 13, wherein said tube includes a plurality of annular ridges on said tube, said opening in said hood having on edge fitting between a pair of annular ridges to hold said hood away from the person's face near said opening, wherein said air pocket is formed..

15. The device in accordance with claim 14 wherein said holding means includes means for elastically gathering said hood material in a region behind a vertical plane through the forwardmost point of said person's ears and beneath the largest horizontal plane through said person's head when said person is standing erect.

16. The device in accordance with claim 15, further comprising lens and wherein said hood includes a lens receptacle around said vision cutouts for receiving said lens.

17. The device in accordance with claim 13, wherein said face portion includes a bottom and opposite sides, said face portion further including means for detachably attaching said bottom and said sides to said hood to enable the wearer to detach and fold said face portion away from the face.

18. The device in accordance with claim 16, wherein said hood comprises a plurality of layers, including means for repelling water and means for insulating the wearer.

19. The device in accordance with claim 1, wherein said cooling adjustment means comprises removable lenses which cover eye openings within said hood.

20. The device in accordance with claim 1, wherein said cooling adjustment means comprises said face portion, wherein a part of said face portion is removably interconnected to said hood.

21. The device in accordance with claim 20, wherein a bottom part of said face portion is removably interconnected to said hood by hook and fastener material and said face portion is attachable to a top portion of said hood by hook and fastener material when the person desires a cooling effect.

22. The device in accordance with claim 4, wherein said cooling adjustment means comprises removable lenses which cover eye openings within said hood.

23. The device in accordance with claim 4, wherein said cooling adjustment means comprises said face portion, wherein a part of said face portion is removably interconnected to said hood.

24. The device in accordance with claim 23, wherein a bottom part of said face portion is removably interconnected to said hood by a hook and fastener material and said face portion is attachable to a top portion of said hood by hook and fastener material when the person desires a cooling effect.

* * * * *

UNITED STATES PATENT AND TRADEMARK OFFICE

CERTIFICATE OF CORRECTION

PATENT NO. : 4,768,235

DATED : September 6, 1988

INVENTOR(S) : Margaret A. Webster

It is certified that error appears in the above-identified patent and that said Letters Patent is hereby corrected as shown below:

Column 1, line 37, "of" should be--to--.

Column 2, line 10, "is" should be--it--.

Column 4, line 4, "grasph" should be--grasp--.

Column 5, lines 57 and 58, "exhause" should be--exhaust--.

Column 6, line 38, "3" should be -- 2 --.

Column 7, line 8, "7" should be -- 5 --.

Signed and Sealed this

Twenty-ninth Day of August, 1989

*Attest:*

DONALD J. QUIGG

*Attesting Officer*

*Commissioner of Patents and Trademarks*